United States Patent [19]

Berger et al.

[11] Patent Number: 4,909,679

[45] Date of Patent: Mar. 20, 1990

[54] PLASTIC LENS EDGE BEVELER

[75] Inventors: Warren A. Berger, Louisa; Lewis D. Houchens, Jr., North Garden; Victor A. Villar-Gosalvez, Ivy, all of Va.

[73] Assignee: National Optronics Inc., Charlottesville, Va.

[21] Appl. No.: 917,080

[22] Filed: Oct. 8, 1986

[51] Int. Cl.[4] ..... B23C 3/04; B24B 9/14

[52] U.S. Cl. ..... 409/104; 51/101 LG

[58] Field of Search ..... 409/104, 122, 132; 51/101 LG, 105 LG, 106 LG, 284 E

[56] References Cited

U.S. PATENT DOCUMENTS

| | | | |
|---|---|---|---|
| 2,333,064 | 10/1943 | Williams et al. | 409/104 |
| 3,087,285 | 4/1963 | Lissac | 51/101 LG |
| 3,332,172 | 7/1967 | Stern | 51/101 LG |
| 3,798,844 | 3/1974 | Hannaman | 51/101 LG |
| 3,828,648 | 8/1974 | Geula | 51/101 LG X |
| 3,894,361 | 7/1975 | Georgiadis et al. | 51/101 LG |
| 4,179,851 | 12/1979 | Neisler et al. | 51/101 LG |
| 4,191,501 | 3/1980 | Sinklier et al. | 409/104 |
| 4,394,099 | 7/1983 | Santinelli | 409/104 |
| 4,640,055 | 2/1987 | Badin et al. | 51/101 LG |

FOREIGN PATENT DOCUMENTS

| | | | |
|---|---|---|---|
| 3343214 | 6/1985 | Fed. Rep. of Germany | 51/101 LG |

*Primary Examiner*—Z. R. Bilinsky

*Attorney, Agent, or Firm*—Shlesinger & Myers

[57] ABSTRACT

A plastic lens shaper and finisher has a bed to which a first frame is mounted for reciprocation along the first axis. A second frame is mounted to the bed for reciprocation along the second axis generally transverse to the first axis. A third frame is secured to the bed adjacent said first and second frames. Displacement devices are operably connected to each of the first and second frames causing reciprocation thereof. A motor is mounted to the first frame and has a rotary cutter secured to the distal end thereof for cutting the blank. A second motor is mounted to the second frame and includes a first blank holding portion at one end and a first pattern holding portion at the other end. The second frame includes a portion carrying the second blank holding portion and a cylinder and piston assembly for driving the second portion for clamping and releasing the blank. A pattern engaging roller is mounted to the third frame for engaging the pattern as it rotates for thereby causing the second frame to be selectively moved on the second axis so that the blank is cut to a predetermined shape.

45 Claims, 7 Drawing Sheets

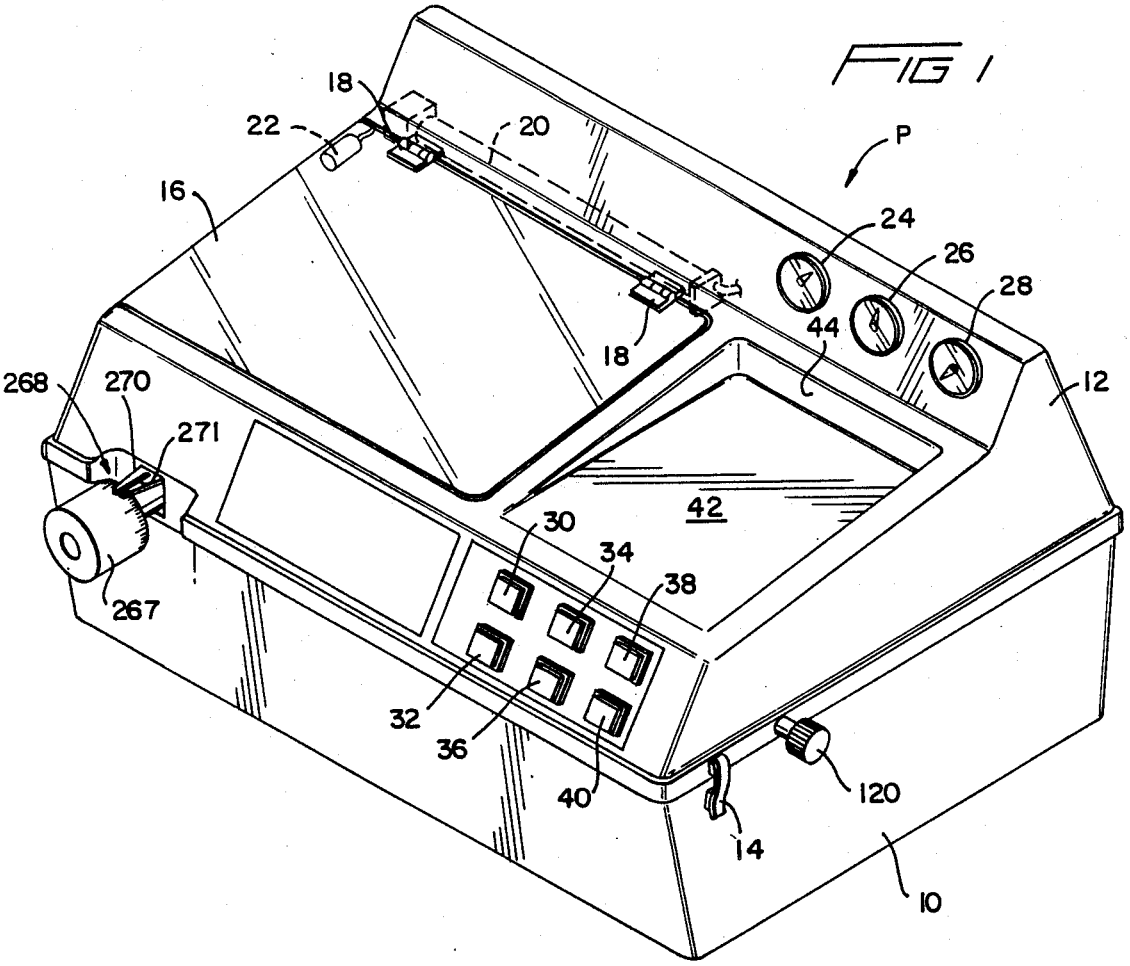
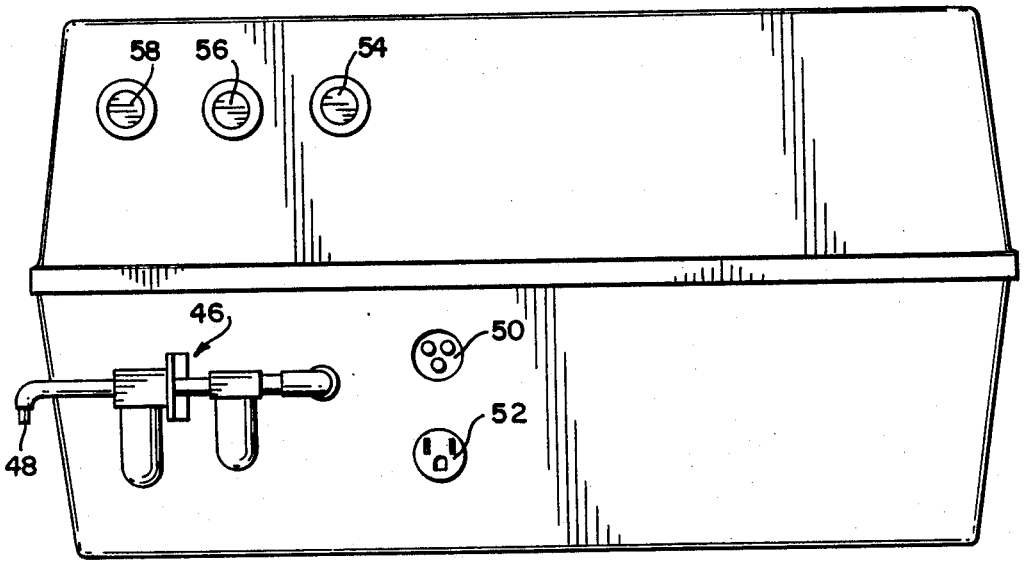
FIG 2

PLASTIC LENS EDGE BEVELER

BACKGROUND OF THE INVENTION

Each eyeglass lens typically has a peripheral beveled edge which seats in a corresponding groove in the eyeglass frame. Typically, the frame is sized to fit the wearer and the lenses must therefore be appropriately sized to fit the frame. Customarily, a right lens and a left lens are required, with the lenses not normally being interchangable. It has been common practice for the optician to stock a supply of lens blanks for the frames, the blanks having the required optical properties and being capable of being cut to the proper size.

Conventional glass lenses are cut to size and beveled with a relatively slowly rotating diamond wheel. Plastic lenses have increased in popularity more recently and conventional diamond grinding techniques are too slow. Router techniques have been used with plastic lenses in view of the highspeed cutting available but pattern warpage has been a problem.

The number and styles of eyeglass frames has increased tremendously and each style typically requires a special lens configuration. It is impractical for the optician to stock a supply of sized blanks for each style of frame, particularly when the necessary optical properties are considered. Furthermore, because of the numerous frame styles, the optician must be able to rapidly shift his shaper and edger from one frame style to another. Typically, each framemaker provides the optician with a pattern or patterns which are used to cut the lenses to fit the frame. Generally, there is one pattern per frame style so the edger and shaper must be able to appropriately cut the lens to the proper size for the given frame.

The high speed rotary cutters used in conventional router techniques generate much dust which must be evacuated to prevent damage to the machine. Furthermore, because of the high speeds employed, it is important that the edger and shaper have appropriate safety devices to prevent the operator from being injured. Conventional diamond grinding machines, on the other hand, generate large quantities of wet waste.

The disclosed invention is a plastic lens shaper and finisher employing router techniques in a manner which permits high speed cutting and finishing of the lenses in a safe way while successfully avoiding the problem of pattern warpage. The invention furthermore can be equipped with digital control systems to eliminate the need for individual physical patterns. The invention utilizes relatively low pressure pneumatic drive systems to control the movement between the shaping and finishing operations so that speed is maximized while pressure on the blank being cut is minimized. Lastly, the disclosed invention is particularly suited for an environment wherein long production runs are not possible and rapid interchangability from one frame style to another is required.

OBJECTS AND SUMMARY OF THE INVENTION

The primary object of the disclosed invention is to provide a plastic lens shaper and finisher which minimizes the force which is applied to the pattern during the cutting operation by mounting the head of the edger for movement in the same plane relative to the carriage assembly which carries the cutter motor.

A further object of the disclosed invention is to provide a plastic lens shaper and finisher wherein the pattern engaging roller assembly is mounted horizontally parallel to the base of the device opposite to the lens drive assembly and wherein the roller rotates on a plane common with the router.

Another object of the disclosed invention is to provide a plastic lens shaper and finisher having pneumatic drive systems provided by cylinder and piston assemblies for the carriage and the head such that one assembly causes rapid movement whereas the other acts as a damping device to minimize the shock of engagement between the router and the raw blank.

In summary, the disclosed invention is a plastic lens shaper and finisher having a metallic bed to which a first frame is mounted for reciprocating motion along a first axis. A router assembly is mounted to the first frame and rotates on a second axis which is parallel to the first. A second frame is mounted to the bed for reciprocating motion along a third axis transverse to the first and second axes and carries a chuck for holding a plastic blank to be shaped. The second frame also carries a pattern holding assembly which rotates in combination with the blank by means of a common motor. A pneumatic drive system is connected to the first frame for moving the first frame between a shape position and a finish position. A similar pneumatic drive system is mounted to the second frame for moving the second frame so that the blank is cut by the router into the appropriate shape and size.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein:

FIG. 1 is a perspective view of the plastic lens shaper and finisher of the invention mounted in its case;

FIG. 2 is a rear elevational view of FIG. 1;

DESCRIPTION OF THE INVENTION

Figure 3:
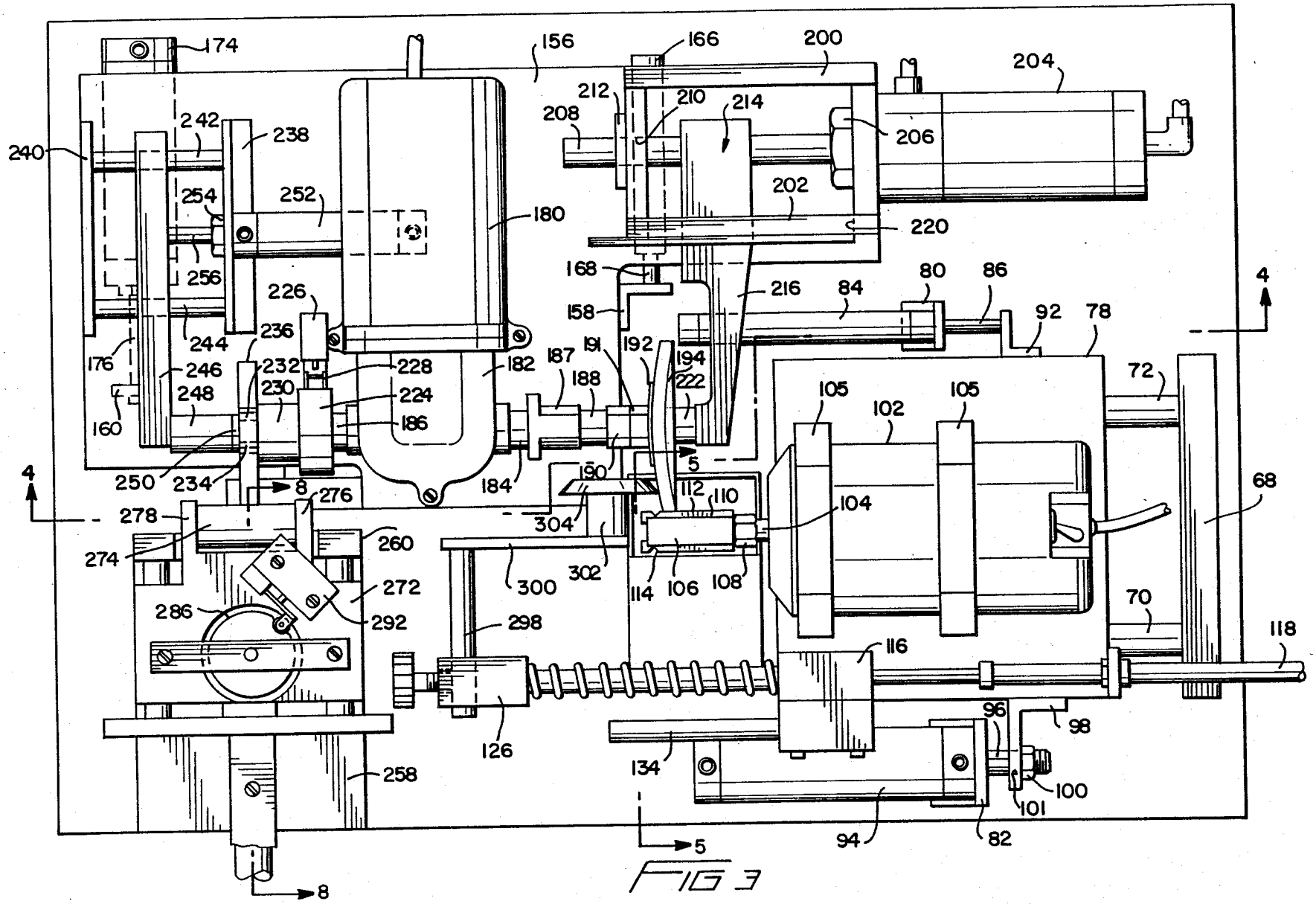
FIG. 3 is a top plan view of the invention with the case removed to permit viewing of the innerworkings.

Plastic lens shaper and finisher P, as best shown in FIG. 1, is particularly intended for the shaping and finishing of plastic lenses although use on other parts is not unanticipated. As used herein, plastic eyeglass lenses include lenses manufactured from CR 39, acrylic and polycarbonate compositions. Naturally, the continuing development of eyeglass technology may result in additional compositions being found suitable for use and the present disclosure is not intended to be limited to the three listed compositions, they being merely illustrative.

Plastic lens shaper and finisher P has an enclosure comprised of bottom member 10 and cover member 12 hingedly connected thereto. Preferably, catch 14 secures cover member 12 to bottom member 10 and prevents unintended opening thereof. Cover member 12 has a clear window 16 mounted thereto by hinges 18, for reasons to be explained later. As illustrated in phantom lines in FIG. 1, electric light 20 is mounted to cover member 12 proximate window 16 to illuminate the device during operation. Also disclosed in FIG. 1 is mercury switch 22 secured to window 16 and pivotal therewith for safety reasons which will be further discussed.

FIG. 1 furthermore discloses air pressure gauges 24, 26 and 28 used in regulating the pneumatic control systems which will be further explained. Also disclosed in FIG. 1 are control switches 30, 32, 34, 46, 38 and 40 which are used in the operation of the device. It can be noted that cover member 12 includes a shelf 42 having an upstanding peripheral wall 44 for holding job trays of finished and uncut blanks.

FIG. 2 discloses the filter assembly 46 as well as connection 48 to the air supply line (not shown). Also illustrated are plug connections 50 and 52 providing control and operating power for shaper and finisher P. Regulators 54, 56 and 58 are also illustrated in FIG. 2, each regulator being associated with one of gauges 24, 26 and 28 for regulating the operating pressure outputted therefrom.

Figure 4:
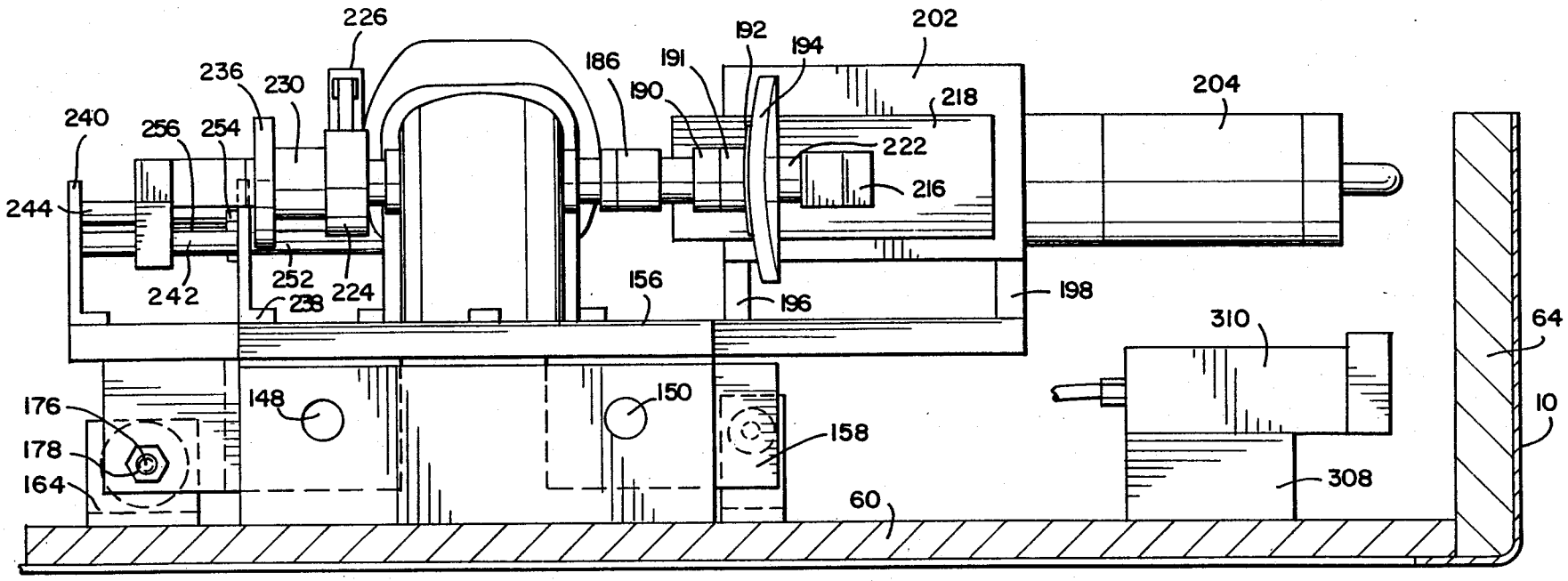
FIG. 4 is a fragmentary cross-sectional view taken along the section 4—4 of FIG. 3 and viewed in the direction of the arrows.

As best shown in FIG. 4, member 10 is a plastic shell which encloses metallic bed 60. Bed 60 has an upper planar surface 62. Sound damping insulation 64 extends along the side walls of member 10. While member 10 is disclosed as a plastic shell, those skilled in the art will appreciate that it can be constructed of other materials. Likewise, cover member 12 is also preferably a plastic shell.

Figure 6:
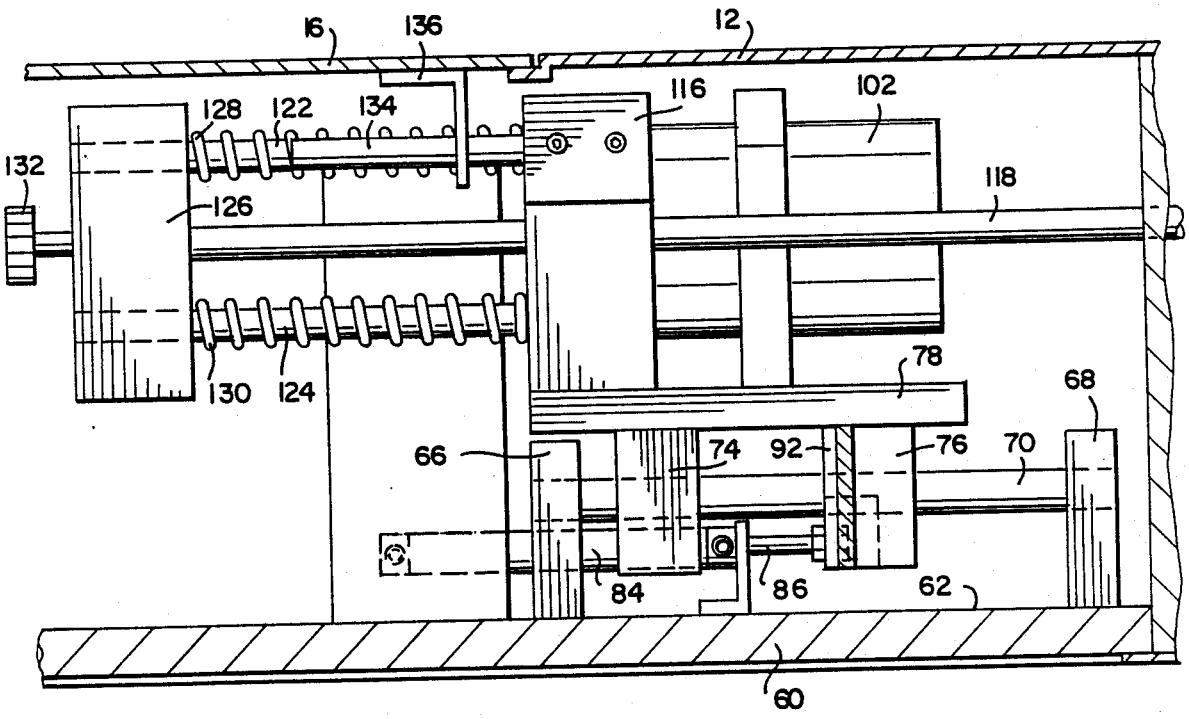
FIG. 6 is a fragmentary elevational view partially in section taken along the section 6—6 of FIG. 3 and viewed in the direction of the arrows.

As best shown in FIG. 6, spaced parallel support blocks 66 and 68 are secured to bed 60. Rods 70 and 72, as best shown in FIGS. 3 and 6, extend between blocks 66 and 68 in spaced parallel relation and are uniformly spaced above surface 62. Supports 74 and 76 are disposed in spaced parallel relation and are slidably mounted to rods 70 and 72 for movement therealong. First frame 78 is secured to supports 74 and 76 and is movable therewith. Mounts 80 and 82, as best shown in FIG. 3, are secured to bed 60 on either side of frame 78. Pneumatic cylinder 84 is secured to mount 80 and piston rod 86 thereof engages and bears upon link 92 secured to and depending from frame 78.

Pneumatic cylinder 94 is secured to mount 82 and piston rod 96 extends therefrom and through link 98 which is secured to and depends from frame 78. Unlike piston rod 86, piston rod 96 has a nut 100 which permits the rod 96 to slide freely through aperture 101, toward the right as viewed in FIG. 3, without causing corresponding movement of frame 78. The nut 100 does, however, engage link 98 upon the piston rod 96 being retracted, or moved toward the left as viewed in FIG. 3, for causing corresponding movement of the frame 78. It can be noted that the cylinder 84 is substantially smaller than the cylinder 94, as is the corresponding piston rod 86 to rod 96. The piston 86 moves rapidly relative to piston 96 for thereby causing associated rapid movement of frame 78. The cylinder 94 is large relative to cylinder 84 and thereby provides a damping effect during movement of the frame 78 by the piston rod 86. In other words, the piston rod 96 limits the absolute movement of the frame 78 and acts as a shock absorber as the frame 78 is moved by the piston rod 86.

As best shown in FIG. 3, electric motor 102 having a high speed rotating shaft 104 is secured to frame 78 by mounts 105. Router head 106 is secured by nut 108 to shaft 104 and carries cutter blades 110. Preferably, each of the blades 110 has a straight portion 112 and a V-portion 114 which bevels the lens blank, as will be further explained. It should be appreciated that the shaft 104 rotates on an axis which is parallel to the axis on which the frame 78 moves.

Bracket 116, as shown in FIGS. 3 and 6, is secured to frame 78 and is movable therewith. Rod handle 118 extends therefrom and terminates in handle 120, as shown in FIG. 1. Rods 122 and 124 extend from bracket 116 oppositely to rod handle 118 and are received within apertures in block 126. Coil springs 128 and 130 are mounted to the rods 122 and 124, respectively, and adjustment knob 132 extends from block 126, for reasons to be explained later. Catch rod 134 extends from bracket 116 parallel to rods 122 and 124, as best shown in FIG. 3. Latch 136 extends downwardly from window 16 and has an aperture 138 through which rod 134 passes. In this way, shifting of frame 78 towards the left, as viewed in FIGS. 3 and 6, will cause the rod 134 to pass through the aperture 138 and therefore prevent opening of window 16.

Figure 5:
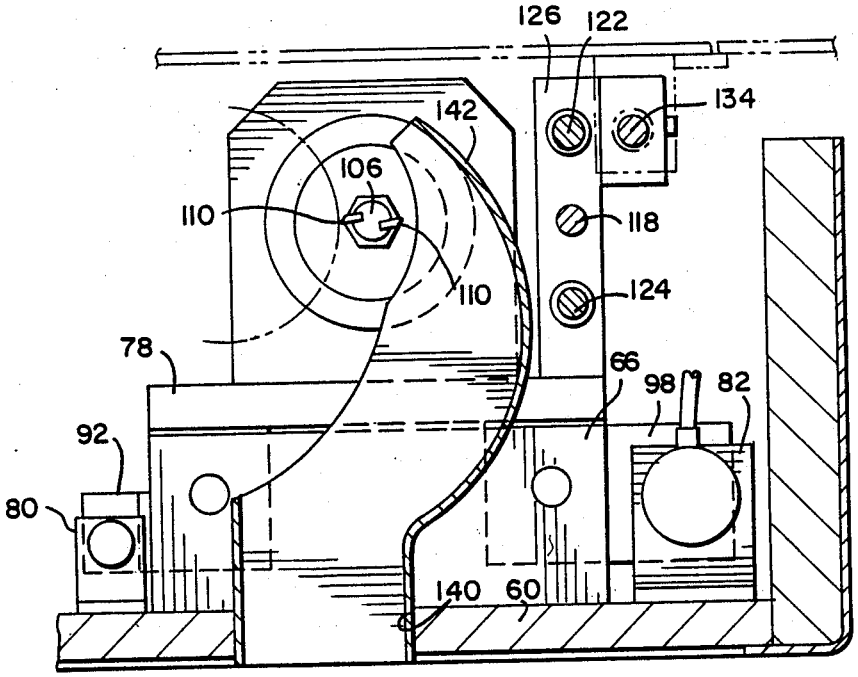
FIG. 5 is a fragmentary cross-sectional view taken along the section 5—5 of FIG. 3 and viewed in the direction of the arrows.

FIG. 5 discloses opening 140 in bed 60. Plastic shroud 142 is secured in opening 140 and extends upwardly therefrom and terminates proximate router 106. A vacuum assembly (not illustrated) is operatively connected with shroud 142 for evacuating dust and the like generated by router 106 during operation thereof. In this way, the dust and other particles do not fill the edger and shaper P and block viewing of the components thereof.

Figure 7:
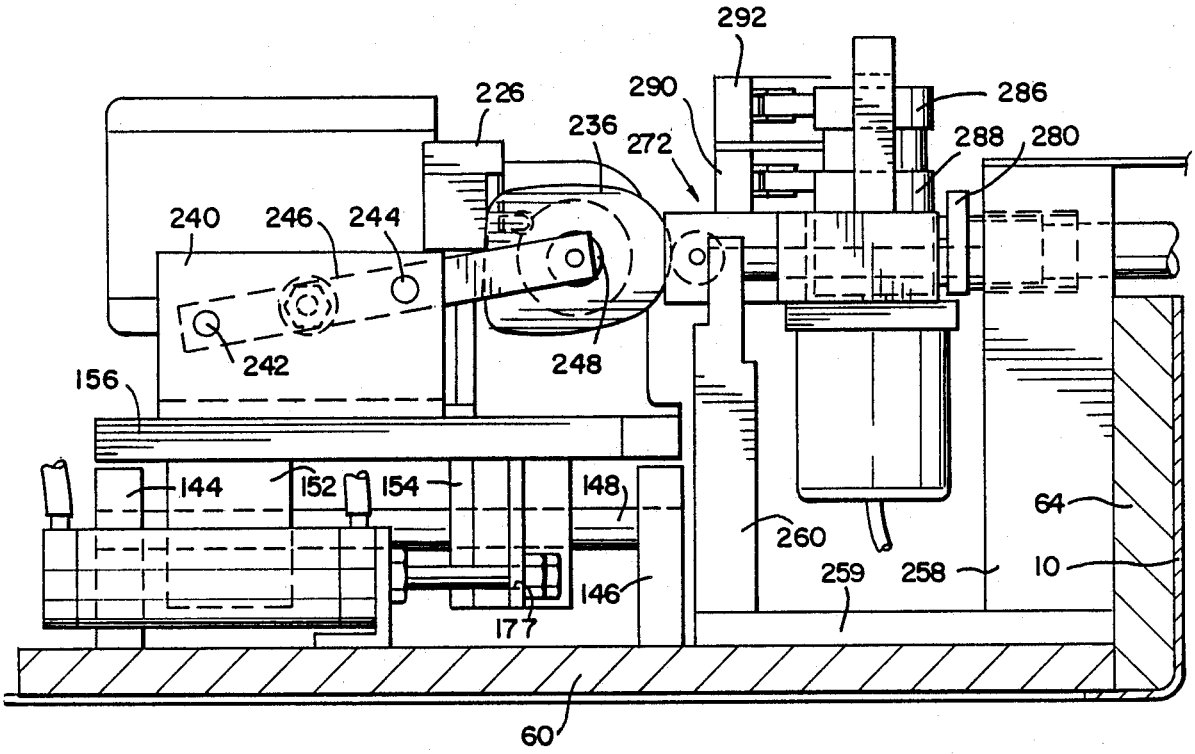
FIG. 7 is a fragmentary side elevational view partially in section.

As best shown in FIG. 7, support blocks 144 and 146 are mounted in spaced parallel relation to bed 60. Rods 148 and 150, as best shown in FIGS. 7 and 4, extend between blocks 144 and 146 in spaced parallel relation and are a uniform distance from surface 62, the distance being equal to that of rods 70 and 72 from bed 60. The rods 148 and 150 extend in a direction generally transverse to the direction in which the rods 70 and 72 extend. Supports 152 and 154 are disposed in spaced parallel relation and are slidably mounted to rods 148 and 150 for movement therealong. Second frame 156 is mounted to supports 152 and 154 and is movable therewith, as will be further explained.

As best shown in FIGS. 3 and 4, links 158 and 160 are secured to and extend outwardly from frame 156 along opposite sides thereof. Support blocks 162 and 164 are secured to bed 60 proximate links 158 and 160, respectively. Pneumatic cylinder 166 is secured to support block 162 and the piston rod 168 thereof is engaged with and bears upon link 158 in a manner similar to the engagement of rod 86 to link 92. Pneumatic cylinder 174 is likewise secured to its support block 164. The piston rod 176 thereof extends through an aperture 177 in link 160 and has lock nuts 178 mounted thereto. As with the piston rod 96, rod 176 may freely slide relative to the link 160 in a first direction but, in the opposite direction thereto, the nut 178 engages the link 160 and causes movement thereof. As with the cylinder and piston assemblies 84, 86 and 94, 96 respectively, of first frame 78, the cylinder and piston assemblies 166, 168 and 174, 176 move the second frame 156 along an axis which is generally transverse to the axis on which the first frame 78 moves. As before, the cylinder 166 is a high speed movement cylinder whereas the cylinder 174 acts as a damping cylinder, to prevent shocking impact with router 106.

Motor 180 is secured to second frame 156 and extends generally transverse to the axis on which the router 106 rotates. Motor 180 is connected to transmission 182 from which shafts 184 and 186 extend in coaxial alignment generally transverse to the axis on which the second frame 156 moves. Shaft 184 has a coupling 187 from which shaft 188 extends in coaxial alignment. First blank holding member 190 is mounted for coaxial rotation which shaft 188 and has a pad 192 which engages plastic blank 194.

It can be noted in FIG. 3 that second frame 156 is generally L-shaped in plan. Support members 196 and 198 are secured to second frame 156 in spaced parallel relation. Wall members 200 and 202 extend therebetween and are likewise secured to second frame 156. Cylinder 204 is secured to support member 198 by lock nut 206. The piston rod 208 thereof extends through aperture 210 of support member 196 and has a cover 212 at the distal end thereof.

Arm 214 is secured to piston rod 208 and includes an extension member 216 which extends through a longitudinally extending slot in wall member 202. As best shown in FIG. 4, cover 218 is secured to extension member 216 and is movable therewith for maintaining the longitudinally extending slot 220 closed to prevent the entrance of dirt or other contaminants.

Extension member 216 carries second blank holding member 222 which engages the blank 194 in coaxial alignment with first blank holding member 190. The blank holding member 222 permits the blank 194 to rotate on its central axis in response to rotation of shaft 184. Those skilled in the art will appreciate that the displacement of rod 208 will cause second blank holding member 222 to approach or move away from blank 194 so as to cause the blank 194 to be clamped between the blank holding members 190 and 222 or to be released therefrom. Preferably, the pad 192 includes an adhesive for securing the blank 194 to block 191. It is also preferred that the blank holding member 190 be readily removable and replacable on the shaft 188 so as to maximize the operation of the shaper P.

As best shown in FIG. 3, shaft 186 has cam 224 mounted thereto for coaxial rotation therewith. Switch 226 is mounted adjacent cam 224 and has a contact member 228 engaged with the cam 224 for determining the proper angular position of shaft 186.

First pattern holding member 230 is mounted to cam 224 for coaxial rotation therewith. Preferably, first pattern holding member 230 has pins 232 and 234 which are positioned in cooperating apertures in pattern 236. The pins 232 and 234 thereby prevent rotation of the pattern 236 relative to the first pattern holding member 230. Therefore the pattern 236 does not come out of position and cause the blank 194 to be cut to other than the prescribed shape. Similarly, because of switch 226, the pattern always is positioned in the same horizontal relation when operation is commenced.

Supports 238 and 240 are secured to second frame 156 in spaced parallel relation and extend parallel to support members 196 and 198. Rods 242 and 244 extend between supports 238 and 240. It can be noted in FIG. 7 that the rod 244 is a slight distance above the second frame 156 relative to the rod 242. Arm 246 is mounted to the rods 242 and 244 for movement therealong between the support members 238 and 240. Arm 246 has second pattern holding member 248 mounted to the distal end thereof. Second pattern holding member 248 rotates on an axis coaxial with shaft 186. Second pattern holding member 248 has contact member 250 which engages pattern 236.

Pneumatic cylinder 252 is secured to support member 238 by lock nut 254. The piston rod 256 thereof is secured to arm 246 and causes the arm 246 to be moved on the rods 242 and 244. Those skilled in the art will appreciate that displacement of the rod 256 will cause corresponding movement of the arm 246 such that the pattern 236 will be clamped or released from between the pattern holding members 230 and 248.

Figure 8:
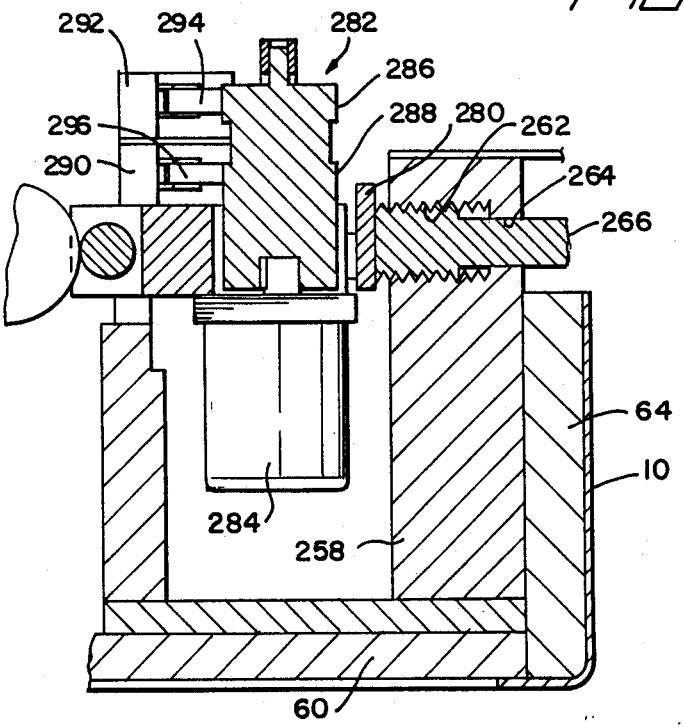
FIG. 8 is a cross-sectional view taken along the section 8—8 of FIG. 3.

As best shown in FIGS. 3 and 7–8, third frame 258 is secured to bed 60 through support 259 and extends upwardly therefrom. Front frame member 260 is similarly secured to support 259 and extends upwardly therefrom in spaced parallel relation relative to third frame 258. Third frame 258 includes threaded aperture 262 in which threaded rod member 264 is rotatably mounted. Threaded member 264 includes a shaft 266 extending therefrom and having a handle 267, as best shown in FIG. 1, exterior of bottom member 10. Preferably, handle 267 has gradients 268 equiangularly marked thereabout. Locator 270 has slot 271 aligned with the gradients 268. Rotation of handle 267 and alignment with of one of the gradients 268 by slot 271 causes the threaded member 264 to move inwardly and outwardly relative to the third frame 258.

Sliding member 272 extends between third frame 258 and front frame member 260 and carries pattern engaging roller 274 which rotates on an axis parallel to the axis of rotation of shafts 184 and 186 and 104. As shown in FIGS. 3 and 7, arms 276 and 278 extend outwardly from sliding member 272 and the roller 274 extends rotatably therebetween. Contact plate 280, as best shown in FIGS. 7 and 8, is engaged with threaded member 264 so that movement of member 264 towards the pattern 236 causes associated displacement of the sliding member 272, and thereby of pattern engaging roller 274. In this way, the pattern engaging roller 274 may be moved inwardly relative to the pattern 236 so that adjustments in the size of the cut blank 194 may be accomplished with precision through the micrometer assembly provided by the gradients 268 and the locator 270. The pattern engaging roller 274 is moved outwardly because of pressure from second frame 156 and the movement outwardly of member 264.

Cam assembly 282 is mounted for rotation on sliding member 272 by means of a cam motor 284. Cam assembly 282 includes first cam portion 286 and second cam portion 288. Cam operated switches 290 and 292 have cam engaging members 296 and 294, respectively, each of which is engageable with one of the cam portions 288 and 286, respectively. In this way, rotation of the cam assembly 282 and causes corresponding rotation of the cam portions 286 and 288 and thereby operation of the switches 190 and 292. The switches 290 and 292 are in electrical connection with the control mechanism, as will be further explained, and cause the first frame 78 to be shifted on its axis.

Figure 9:
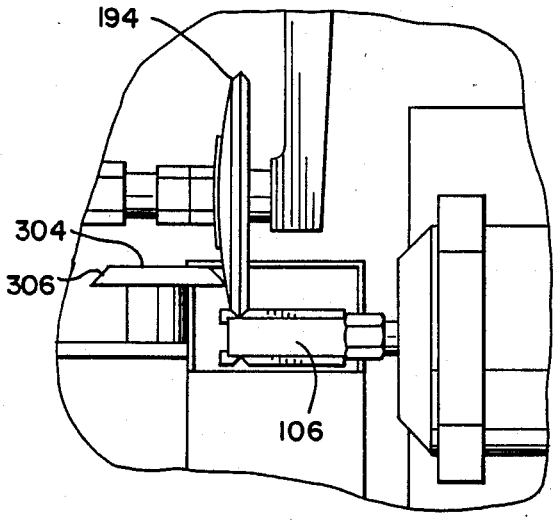
FIG. 9 is a top plan view illustrating the device in the finish position; and, FIG. 10 is a schematic view illustrating the control system of the invention.

As best shown in FIGS. 3 and 9, arm 298 extends from bracket 116 and carries support 300 at the distal end thereof and the height of support 300 can be adjusted through knob 132. Shaft 302 is mounted for rotation to support 300 and has wheel 304 at the distal end thereof. As can be seen in FIGS. 3 and 9, wheel 304 has an angled periphery 306 which is engaged with the blank 194 during the cutting operation thereof. In this way, the periphery 306 engages blank 194. It can be noted in FIG. 9 that the periphery 306 is radially inwardly spaced from the V-shaped beveled edge of the blank 194.

FIG. 4 discloses support block 308 to which solenoid assemblies 310 are mounted. Those skilled in the art will understand that a solenoid 310 is required for causing operation of the cylinder and piston assemblies hereof in order to effectuate movement of the frames 78 and 156, as well as of the arm 214. While only one solenoid assembly is illustrated in FIG. 4, those skilled in the art can appreciate that that appropriate number is provided.

Figure 10:
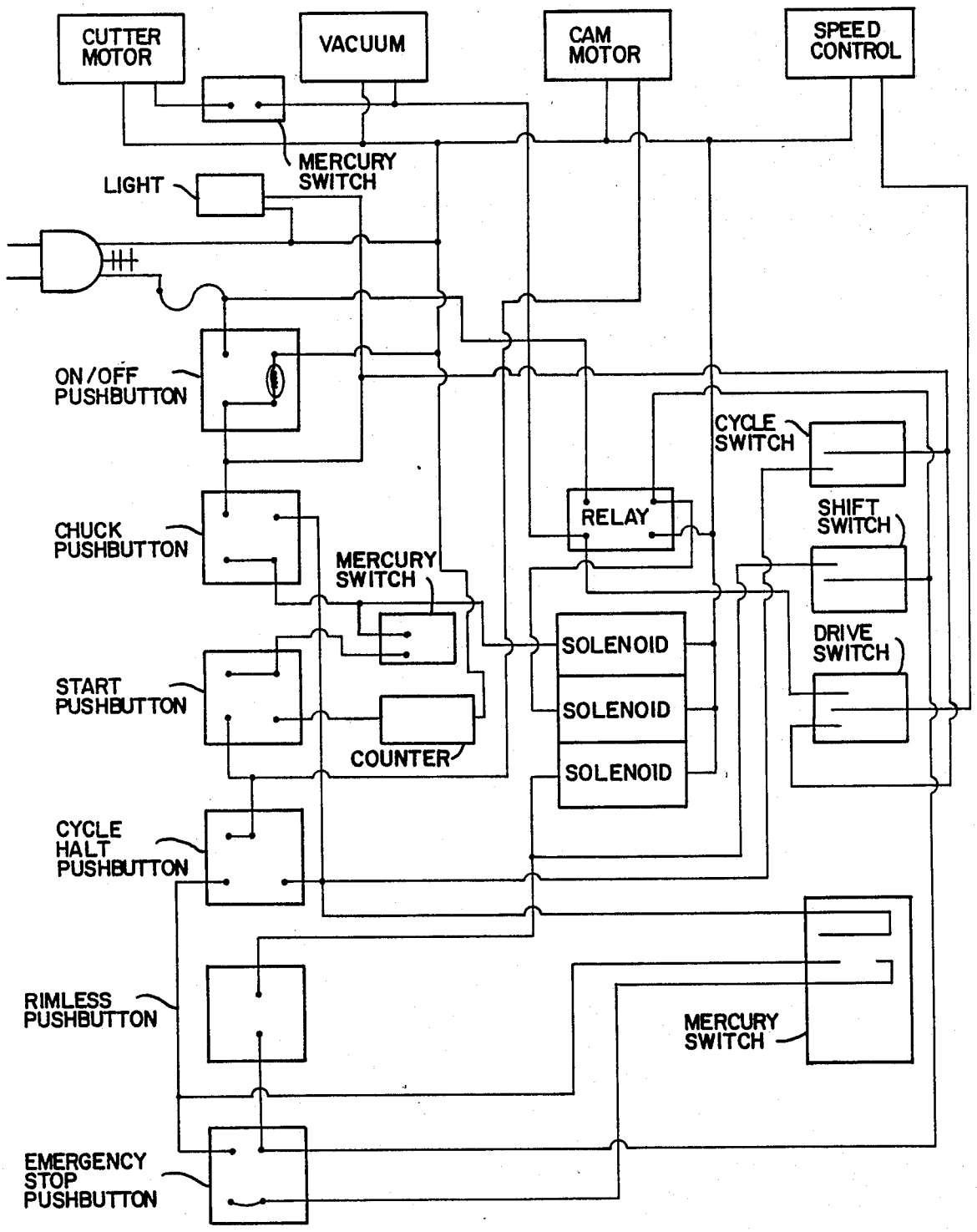

FIG. 10 illustrates the wiring schematic which controls the operation of plastic lens finisher and shaper P. The cutter motor is connected to a mercury switch affixed to the underside of cover member 12 so that the motor will not operate when the cover member 12 is raised. Similarly, the vacuum which evacuates air and dust through shroud 142 is in circuit connection with the cutter motor, as is the cam motor and the speed control device for the motor 180 which rotates the pattern and the lens blank.

FIG. 10 also illustrates the on/off push button, as well as the chuck push button, the start push button which initiates operation of the device, the cycle halt push button, the rimless push button and the emergency stop push button. These push buttons correspond with the push buttons 30, 32, 34, 36, 38 and 40 and have for their purpose the selective operation of the shaper and finisher P. The start push button is in circuit connection with the mercury switch 22 to prevent the motor 102 from being operated when the window 16 is in the up position. Also in circuit connection with the start push button is a counter assembly so that the operator will know how many lens blanks 194 have been cut. The solenoid assemblies 310 are also in circuit connection with the push buttons and it can be noted that three solenoid assemblies are provided. Also in circuit connection with the start button is a relay which permits operation of the device.

Yet another mercury switch is affixed to the underside of window 16 and is a safety feature which prevents the cam motor 284 from being started unless cover 12 is lowered and the chuck push button depressed.

A cycle switch is also provided for keeping the cycle going once initiated. A shift switch is provided which operates in conjunction with the cam assembly 282 for shifting the first frame 78 to the right so that the V-portion 114 is engaged with the periphery of the blank 194 after the initial shaping has occurred. A drive switch is also provided for keeping the motor 180 operating so that the pattern 236 is always in a preselected, preferably horizontal position, when the start push button is initiated.

OPERATION

The plastic lens shaper and finisher P is relatively simple to operate because of the pneumatic cylinder and piston assemblies which drive the first frame 78 and the second frame 156 and which operate the pattern clamping mechanism and the lens blank clamping mechanism.

Initially, the connection 48 must be made with a source of pressurized air and, naturally, power provided through plug connections 50 and 52. The on/off push button is then depressed to power the system and to operate the light 20 under the window 16. The handle 120 is then slid to the right by movement of frame 78 at the end of the previous cycle, as viewed in FIG. 1, and the window 16 may then be raised because the rod 134 will have been removed from the aperture 138 in the latch 136. The appropriate pattern 236 is then mounted to the pins 232 and 234 of first pattern holding member 230. A lens blank 184, having affixed thereto pad 192 and block 191 is indexed with first pattern holding member 190.

The chuck push button is depressed which thereby causes the arm 246 to be displaced so that the contact member 250 engages the pattern 236 and clamps the pattern 236 between the first and second pattern holding members 230 and 248, respectively. Simultaneously, the piston rod 208 likewise shifts and thereby causes the second blank holding member 222 to engage the blank 194 and thereby secure the blank 194 between the first and second pattern holding members 190 and 222. The window 16 may then be lowered.

At this time, or even earlier, the handle 267 is rotated to cause the appropriate gradient 267 to be aligned in the notch 271 of the locator 270 so that the proper size is selected. As previously explained, rotation of the handle 267 causes cooperating inward movement of the sliding member 272 so that the pattern engaging roller 274 is moved inwardly. Naturally, rotation of handle 267 in the opposite direction will permit sliding member 272 to slide in the opposite direction.

Assuming that a beveled edge is desired for the finished blank 194, then the start push button is depressed which shifts frame 78 to the left and thereby secures rod 134 in latch 136. This causes the counter to signal one cycle and also initiates the solenoids which drive the first and second frames 78 and 156, respectively. Shifting of first frame 78 to the left, as viewed in FIG. 3, aligns the straight portion 112 of the blades 110 with the periphery of the blank 194. As noted in FIG. 3, this also causes the periphery 306 of the wheel 304 to engage the side surface of the blank 194.

Simultaneously, the piston 176 is displaced, as is the piston 168 which causes movement of the frame 156 along the travel axis. The piston 176 continues to be displaced and thereby permits the piston 168 to continue to displace the frame 156 toward the router 106. Eventually, displacement of the piston 168 causes the pattern 236 to engage the pattern roller 274, such that the cylinder 174 need no longer function as a damper. At this point, the piston 168 of the cylinder 166 is responsible for exerting the necessary application pressure so that the pattern 236 stays in engagement with the pattern engaging roller 274, which necessarily causes the blank 194 to be cut by the router 106.

Those skilled in the art will appreciate, and as illustrated in FIG. 7, that the pattern 236 is of non-uniform contour such that the periphery thereof is not a constant distance from the central rotational axis thereof. The overall effect is that engagement of the pattern 236 with the roller 274 causes the frame 156 to be shifted toward and away from the router 106 as dictated by the contour of the pattern 236. The relatively small cylinder 166 is not pressurized by an amount which would prevent the piston 168 from being displaced inwardly toward the cylinder 166 when forced in that direction by the contour of the pattern 236. The net result is that the piston rod 168 moves in response to the contour of the pattern 236 but maintains essentially uniform pressure so that constant cutting pressure is maintained between the periphery of the blank 194 and the router 106. Damping by cylinder 174 is not needed after engagement because the pattern 236 typically does not change its contour by an amount which cannot be accommodated by movement of piston 168.

While this preferred embodiment is described with reference to a physical pattern 236, those skilled in the art will appreciate that modern computer techniques are sufficient to permit digitization of a pattern. Digitization would avoid the necessity of the physical pattern, as well as the cam and cam switches related thereto.

The cam assembly 282 rotates in cooperation with rotation of the pattern 236 and the blank 194. After the blank 194 has completed slightly in excess of one rotation, as noted by the cam 286 and the cam switch 292, then the first frame 78 is shifted to the right so that the V-shaped beveled portion 114 is aligned with the blank 194. Again, substantially one revolution of the blank 194 is made, as indicated by the cam 288 and the cam switch 290, and the blank is then appropriately shaped and edged. The cycle stops automatically and the operator may depress the chuck push button so as to permit removal of the finished blank 194 after switch 226 indicates proper horizontal positioning of the pattern 236.

Should the blank 194 not require a beveled edge, then the operator can merely depress the rimless push button. This has the effect of completing the shaping and finishing operation by avoiding the shifting of the first frame 78 to the right.

Should the operator desire to halt the cycle at some point, for whatever reason, then he need merely depress the cycle halt push button. This has the effect of stopping motor 284 causing the shaper and finisher P to remain at that point in the cycle until the cycle halt push button is depressed again.

The switch 226 engaged with cam 224 assures that the pattern 236 is always in the same initial starting position when the device is operated because the cycle terminates when the pattern 236 reaches this position.

Should the pattern need to be changed, because a different type lens is to be cut, for example, then the operator need merely depress the chuck push button in order to access the pattern 236 and permit its changing. The disclosed invention also makes it possible to cut a pattern from a previously finished lens. This is because the cutting pressure exerted by the piston 168 is so relatively slight that the pattern material will not become distorted. Heretofore, it has been necessary for the operator to have a pattern, as determined by the manufacturer, or else no lens could be cut unless the operator had a pattern maker. Now, because the right and left lens are mirror images of each other, a pattern can be made from one lens to permit the cutting and finishing of the other other.

While this invention has been described as having a preferred design, it is understood that it is capable of further modifications, uses and/or adaptations of the invention following in general the principle of the invention and including such departures from the present disclosure has come within known or customary practice in the art to which the invention pertains, and as may be applied to the central features hereinbefore set forth, and fall within the scope of the invention of the limits of the appended claims.

What we claim is:

1. A plastic lens shaper and finisher, comprising:

(a) a bed;

(b) a first frame mounted to said bed for reciprocating motion along a first axis;

(c) rotary cutter means mounted to said first frame and movable therewith and said cutter means rotatable on a second axis parallel to said first axis;

(d) first motor means for rotating said cutter means;

(e) a second frame mounted to said bed for reciprocating motion along a third axis transverse to said first and second axis;

(f) chuck means for holding a blank to be shaped mounted to said second frame and movable therewith;

(g) second motor means operably connected to said chuck means for rotating said chuck means and thereby the blank on a fourth axis parallel to said first and second axes and transverse to said third axis;

(h) first fluidic drive means operably associated with said first frame for shifting said first frame along said first axis between a shape position and a finish position and including a first reciprocable distance limiting cylinder and piston assembly and a first reciprocable drive cylinder and piston assembly;

(i) second fluidic drive means operably associated with said second frame for shifting said second frame along said third axis so that the blank engages said cutter means for being cut thereby and including a second reciprocable distance limiting cylinder and piston assembly and a second reciprocable drive cylinder and piston assembly;

(j) means operably associated with said second drive means for securing a pattern and thereby causing shifting of said second frame so that the blank is cut to a predetermined shape; and, (k) means associated with said securing means and with said first drive means for causing shifting of said first frame between said positions.

2. The shaper and finisher of claim 1, wherein:

(a) said second and fourth axes lie on a common plane.

3. The shaper and finisher of claim 1, wherein:

(a) first and second bracket means extend from said first frame;

(b) said first drive cylinder and piston assembly has the cylinder thereof secured to said bed and the piston thereof secured to said first bracket means whereby extension and retraction of the piston causes associated displacement of said first frame;

(c) said second bracket means has an aperture therethrough; and, (d) said first distance limiting cylinder and piston assembly has the cylinder thereof secured to said bed and the piston thereof extends through said aperture and the distal end of the piston has lock means engageable with said second bracket means for controlling displacement of said first frame.

4. The shaper and finisher of claim 3, wherein:

(a) first and second spaced apart parallel rod means are secured to said bed; and,
(b) means are associated with said first frame engageable with said rod means for guiding said first frame along said rod means.

5. The shaper and finisher of claim 1, wherein:
(a) support means extend from said first frame parallel to said first axis; and,
(b) contact wheel means are rotatably mounted to the distal end of said support means for engagement with the blank when said first frame is in said finish position and said contact wheel means are rotatable on a fifth axis transverse to said support means.

6. The shaper and finisher of claim 1, wherein:
(a) said cutter means includes a router having a first uninterrupted portion for shaping the blank and a contoured portion for finishing the blank.

7. The shaper and finisher of claim 1, wherein:
(a) said bed is positioned in an enclosure;
(b) said enclosure has a window portion hingedly connected to said enclosure substantially spanning between said pattern means and said chuck means for permitting access thereto;
(c) a latch extends from said window portion into said enclosure; and,
(d) lock means extend from said first frame engageable with said latch for preventing pivoting of said window portion when said first frame is in a first position and permitting pivoting of said window portion when said first frame is in a second position.

8. The shaper and finisher of claim 7, wherein:
(a) switch means are mounted to said window portion and pivotal therewith and are in circuit connection with said first motor means for preventing operation thereof when said window portion is pivoted and for permitting operation thereof when said window portion is not pivoted.

9. The shaper and finisher of claim 1, wherein:
(a) third and fourth bracket means extend from said second frame;
(b) said second drive cylinder and piston assembly has the cylinder thereof secured to said bed and the piston thereof secured to said third bracket means so that extension and retraction of the piston causes associated displacement of said second frame;
(c) said fourth bracket means has an aperture therethrough; and,
(d) said second distance limiting cylinder and piston assembly has the cylinder thereof secured to said bed and the piston thereof extends through said aperture and the distal end of the piston has lock means engageable with said fourth bracket means for controlling displacement of said second frame.

10. The shaper and finisher of claim 9, wherein:
(a) third and fourth spaced apart parallel rod means are secured to said bed and extend parallel to said third axis; and,
(b) means are associated with said second engageable and are with said third and fourth rod means for guiding said second frame along said rod means.

11. The shaper and finisher of claim 1, wherein:
(a) said first distance limiting cylinder and piston assembly extends parallel to said first drive cylinder and piston assembly and transverse to said second distance limiting cylinder and piston assembly and said second distance limiting cylinder and piston assembly extends parallel to said second drive cylinder and piston assembly.

12. The shaper and finisher of claim 1, wherein:
(a) first and second drive means are positioned between said bed and the associated frames.

13. The shaper and finisher of claim 1, wherein:
(a) said second motor means includes a rotatable shaft extending therefrom and defining said fourth axis;
(b) a first chuck portion is mounted to the distal end of said second motor means shaft and includes first means for engaging the blank;
(c) said second frame includes a frame portion mounted to and movable with said second frame;
(d) a second chuck portion is mounted to said frame portion for reciprocating motion and includes second means for engaging the blank; and,
(e) third fluidic drive means are operatively associated with said second chuck portion for moving said second chuck portion between an engaged and a disengaged position.

14. The shaper and finisher of claim 13, wherein:
(a) said frame portion and said third fluidic drive means extend transverse to said third axis;
(b) said third fluidic drive means includes a cylinder and piston assembly having a reciprocating piston; and,
(c) an arm is carried by and movable with said third drive means piston and said second means is mounted to the distal end of said arm.

15. The shaper and finisher of claim 1, wherein:
(a) said second motor means includes a rotatable shaft having said chuck means at one end thereof and first pattern receiving means at the opposite end thereof.

16. The shaper and finisher of claim 15, wherein:
(a) fourth fluidic drive means being mounted to and movable with said second frame and include a reciprocating piston; and,
(b) second pattern receiving means are movable with said fourth drive means piston for being shifted between a pattern received position adjacent to and clamping a pattern between said first pattern receiving means and a pattern removed position spaced therefrom.

17. The shaper and finisher of claim 16, wherein:
(a) said fourth fluidic drive means extends parallel to said second motor means shaft.

18. The shaper and finisher of claim 16, wherein:
(a) a pattern engaging roller is mounted to said bed adjacent said first pattern receiving means so that rotation of said second motor means shaft causes a pattern clamped between said pattern engaging portions to engage said roller and thereby cause associated movement of said second frame so that the blank is cut to a shape conforming to the pattern.

19. The shaper and finisher of claim 18, wherein:
(a) said pattern engaging roller has a diameter substantially equal to the diameter of said cutter means.

20. The shaper and finisher of claim 1, further comprising:
(a) a third frame secured to said bed and being longitudinally spaced from said first frame;
(b) said pattern means, includes a pattern receiving member carried by said second frame for being rotated by said second motor means and a pattern engaging roller rotatably and displacably mounted to said third frame for contacting a pattern carried by said pattern receiving member; and, (c) means are operably associated with said third frame for displacing said pattern engaging roller to permit adjusting of the size of the finished blank.

21. A compact shaper and finisher for plastic lenses, comprising:

(a) a bed lying on a horizontal plane;

(b) a first frame mounted to said bed for reciprocating displacement along a first axis parallel to said plane;

(c) first motor means mounted to said first frame and movable therewith and including a first shaft rotatable on a second axis parallel to said first axis;

(d) rotary cutter means coaxially mounted to the distal end of said shaft, (e) a second frame mounted to said bed for reciprocating displacement along a third axis transverse to said first axis and parallel to said plane;

(f) second motor means mounted to said second frame and movable therewith and including a shaft rotatable on a fourth axis parallel to said second axis;

(g) first clamp means secured to the distal end of said second motor means shaft and rotatable therewith;

(h) first support means secured to said second frame and movable therewith generally parallel to said plane;

(i) a first arm displacably supported by said first support means and including second clamp means aligned with said first clamp means;

(j) first drive means operably connected to said arm for reciprocating said arm and thereby positioning said second clamp means proximate said first clamp means so that a blank may be clamped therebetween;

(k) pattern holding means operably associated with said second frame and movable therewith for causing said second frame to be selectively displaced along said third axis so that the blank is cut by said cutter means to a preselected shape;

(l) first displacement means for reciprocating said first frame; and (m) second displacement means for reciprocating said second frame.

22. The shaper and finisher of claim 21, wherein:

(a) said first support means includes a frame portion secured to and carried by said second frame; and, (b) said first drive means includes a cylinder and piston assembly mounted to said frame portion and the piston thereof is reciprocable and secured to said first portion for causing movement of said first arm.

23. The shaper and finisher of claim 22, wherein:

(a) a support member is secured to said frame portion and extends parallel to and is disposed between said fourth and fifth axes; and, (b) said first arm has a portion thereof engaged with and supported by said support member during displacement.

24. The shaper and finisher of claim 22, wherein:

(a) said frame portion includes first and second spaced parallel sidewalls extending parallel to said fourth axis;

(b) first and second endwalls are secured to said sidewalls at the ends thereof and each of said end-walls has a central aperture; and, (c) the cylinder of said cylinder and piston assembly is secured to said first endwall and the piston thereof extends through said apertures.

25. The shaper and finisher of claim 21, wherein:

(a) vacuum means are disposed proximate said cutter means for evacuating waste during cutting of the blank.

26. The shaper and finisher of claim 22, wherein:

(a) said first and second displacement means each includes a cylinder and piston assembly and said first displacement means are disposed parallel to said first drive means.

27. The shaper and finisher of claim 21, wherein:

(a) first support means extend from said first frame parallel to said first axis and are displacable with said first frame; and, (b) a contact wheel is carried by said support means for rotation on a sixth axis extending transverse to said first axis and is engageable with the blank during cutting thereof.

28. The shaper and finisher of claim 27, wherein:

(a) means are associated with said first support means for positioning said contact wheel along said sixth axis.

29. The shaper and finisher of claim 21, wherein:

(a) a third frame is secured to said bed proximate said first and second frames;

(b) a pattern engaging roller is mounted to said third frame for rotation on a seventh axis parallel to said second axis; and, (c) pattern carrying means for carrying a pattern are mounted to said first shaft and rotatable therewith for engaging said roller and thereby causing selective displacement of said second frame so that the blank approaches and moves away from said cutter means in a predetermined pattern so that the blank is cut to a predetermined shape.

30. The shaper and finisher of claim 29, wherein:

(a) said first clamp means are mounted to a first end portion of said first shaft and said pattern carrying means are mounted to a second end portion thereof.

31. The shaper and finisher of claim 30, wherein:

(a) size adjustment means are associated with said third frame for selectively moving said roller relative to said second axis so that the blank is cut to a predetermined size.

32. The shaper and finisher of claim 29, wherein:

(a) said second and seventh axes are equidistant said bed.

33. A plastic lens shaper and finisher, comprising:

(a) a bed lying on a horizontal plane;

(b) a first frame mounted to said bed for reciprocation along a first axis parallel to said plane;

(c) a second frame mounted to said bed for reciprocation along a second axis generally transverse to said first axis and parallel to said plane;

(d) a third frame secured to said bed adjacent said first and second frames and extending generally transverse to said plane;

(e) first and second displacement means, each of said displacement means operatively connected to one of said first and second frames for causing reciprocation thereof along the associated axes;

(f) first rotary drive means mounted to said first frame and rotatable therewith and including a first shaft rotatable on a third axis parallel to said first axis;

(g) rotary cutter means secured to the distal end of said first shaft;

(h) second rotary drive means mounted to said second frame and movable therewith and including a second shaft rotatable on a fourth axis transverse to said second axis and parallel to said first axis;

(i) first blank holding means mounted to a first end portion of said second shaft and rotatable therewith and being proximate said cutter means;

(j) second movable blank holding means mounted to said second frame and movable therewith;

(k) third displacement means mounted to said second frame and operatively connected to said second blank holding means for moving said second blank holding means toward and away from said first blank holding means for causing a blank to be selectively secured and released;

(l) pattern receiving means for carrying a pattern mounted to the opposite end portion of said second shaft and rotatable therewith;

(m) a pattern engaging roller mounted to said third frame for rotation on a fifth axis parallel to said third axis and parallel to said plane;

(n) said roller engageable with a pattern carried by said pattern receiving means for causing selective movement of said second frame along said second axis so that a blank selectively approaches and moves away from said cutter means and is thereby cut to a predetermined shape; and (o) means operatively associated with said third frame for displacing said roller parallel to said plane so that the size of the blank to be cut may be selected.

34. The shaper and finisher of claim 33, wherein:

(a) each of said first and second displacement means includes a first and a second cylinder and piston assembly;

(b) each of said first cylinder and piston assemblies has a displacable portion operatively connected to the associated frame for causing movement thereof in a first direction along the associated axis; and, (c) each of said second cylinder and piston assemblies has a displacable portion secured to the associated axis in the first direction and in a second direction opposite thereto.

35. The shaper and finisher of claim 34, wherein:

(a) a bracket is secured to each of said first and second frames and is movable therewith;

(b) each of said brackets has an aperture therethrough;

(c) the cylinder of each first cylinder and piston assembly is secured to said bed;

(d) the piston of each of said first cylinder and piston assemblies has a portion thereof extending through the associated aperture; and, (e) lock means are secured to each piston portion engageable with the associated bracket so that movement of said piston causes said lock means to engage the bracket and move the bracket and thereby the associated frame.

36. The shaper and finisher of claim 33, wherein said means for displacing said third frame includes;

(a) a movable portion movable transverse to said fifth axis;

(b) said pattern engaging roller is mounted to and movable with said movable portion; and, (c) movement means are operably associated with said movable portion for causing movement thereof.

37. The shaper and finisher of claim 33, wherein:

(a) said rotary cutter means includes a rough cut portion and a finish cut portion; and, (b) control means are operably associated with said pattern means and with said first displacement means for selectively moving said first frame for causing the blank to be selectively cut by said rought cut and said finish cut portions.

38. The shaper and finisher of claim 37, wherein:

(a) rotary switch means are in circuit connection with said rotary drive means and with said control means for activating said control means and thereby causing shifting of said first frame.

39. The shaper and finisher of claim 33, wherein:

(a) first and second spaced parallel members are mounted to said second frame;

(b) support means extend between said members;

(c) an arm is movable on said support means;

(d) said pattern receiving means includes a first and second receiving portion, said first portion is secured to said second shaft and said second portion is secured to said arm; and, (e) drive means are operatively connected to said arm for moving said arm and thereby causing said second portion to approach and move away from said first portion for clamping and releasing a pattern therebetween.

40. The shaper and finisher of claim 33, wherein:

(a) said fifth and third axes are uniformly spaced from said bed.

41. The shaper and finisher of claim 33, wherein:

(a) lens engagement means re secured to and movable with said first frame and include a rotatable disk engagable with the blank.

42. The shaper and finisher of claim 38, wherein:

(a) said rotary switch means are mounted to said third frame movable portion;

(b) said rotary switch means includes a rotatable cam having first and second cam portions;

(c) means are operatively associated with said switch means for rotating said cam; and, (d) said rotary switch means includes first and second switch means, each of said switch means has a portion thereof engageable with one of said cam portions.

43. The shaper and finisher of claim 42, wherein:

(a) said cam is rotatable on a sixth axis extending generally transverse to said fifth axis and perpendicular to said bed.

44. The shaper and finisher, of claim 41, wherein:

(a) vacuum means are disposed adjacent said lens support means when engaged with the blank for removing waste.

45. The shaper and finisher of claim 37, wherein:

(a) said control means includes solenoid means; and (b) said solenoid means are mounted to said bed beneath said third displacement means and between said first and second frames.

* * * * *